United States Patent [19]

Anderson

[11] 4,120,704

[45] Oct. 17, 1978

[54] MAGNETIC ALLOY AND PROCESSING THEREFOR

[75] Inventor: Richard L. Anderson, Marengo, Ill.

[73] Assignee: The Arnold Engineering Company, Marengo, Ill.

[21] Appl. No.: 789,747

[22] Filed: Apr. 21, 1977

[51] Int. Cl.[2] ..... C21D 1/04; C22C 38/30

[52] U.S. Cl. ..... 148/103; 75/122; 75/126 G; 75/126 H; 148/31.57; 148/120; 148/121

[58] Field of Search ..... 148/120, 101, 121, 31.57, 148/103; 75/126 H, 126 G, 128 E, 123 E, 122

[56] References Cited

U.S. PATENT DOCUMENTS

| | | | |
|---|---|---|---|
| 2,643,949 | 6/1953 | Tisdale et al. | 75/123 E |
| 3,600,162 | 8/1971 | Kaplan et al. | 75/126 H |
| 3,806,336 | 4/1974 | Kaneko et al. | 75/122 |
| 3,922,166 | 11/1975 | Koros et al. | 75/123 E |
| 3,954,519 | 5/1976 | Inoue | 148/31.57 |
| 4,008,105 | 2/1977 | Yuda et al. | 148/101 |
| 4,075,437 | 2/1978 | Chin et al. | 75/126 H |

FOREIGN PATENT DOCUMENTS

| | | | |
|---|---|---|---|
| 982,658 | 2/1965 | United Kingdom | 148/101 |

*Primary Examiner*—Arthur J. Steiner

*Attorney, Agent, or Firm*—Vincent G. Gioia; Robert F. Dropkin

[57] ABSTRACT

An iron-chromium-cobalt magnetic alloy characterized by good magnetic quality, improved hot and cold ductility and by a reduction in the minimum temperature for complete solutioning; and processing for producing said alloy. Hot ductility is improved through controlled additions of rare earth elements in conjunction with modified refining. Cold ductility is improved through a rapid cool subsequent to hot working and prior to cold working. Solutioning temperatures are lowered through controlled additions of vanadium and titanium.

24 Claims, No Drawings

MAGNETIC ALLOY AND PROCESSING THEREFOR

The present invention relates to a magnetic alloy and to improvements in the manufacture thereof.

Magnetic alloys having magnetic properties competitive to Alnico type alloys and a degree of ductility superior to that of Alnico alloys, are produced from alloys of iron, chromium and cobalt. To date, Alnico alloys have been the mainstay of the magnet industry.

In order to permit the production of ternary iron-chromium-cobalt alloys by commerically available processes, ferrite stabilizing elements are added thereto. Attempts to modify said ternary alloy system with various ferritizers such as silicon, columbium, aluminum, molybdenum and tungsten have, however, been less than satisfactory. Hot and cold ductility has not been as hoped for. Success in lowering solutioning temperatures has also been limited.

Through this invention, there is provided an iron-chromium-cobalt alloy characterized by good magnetic quality, improved hot and cold ductility, and by a reduction in the minimum temperature for complete solutioning thereof. Controlled additions of rare earth elements, in conjunction with improved processing, have been found to improve the hot ductility of the alloy. Additions of vanadium and titanium have been found to lower its minimum solutioning temperature. Rapid cooling of the hot worked alloy, directly from the hot working operation or from a subsequent solutioning, has been found to improve its cold ductility.

Iron-chromium-cobalt magnetic alloys are discussed in U.S. Pat. Nos. 3,806,336; 3,954,519; and 3,982,972, and in the following I.E.E.E. Transactions on Magnetics: Vol. Mag-11, No. 5, pages 1443–1445, September 1975; and Vol. Mag-12, No. 6, pages 977–979, November 1976. Although these patents and publications disclose various chemistries for such alloys, none of them disclose rare earth additions, nor refining and quenching as called for by the subject invention. Still other patents, U.S. Pat. Nos. 2,553,330; 3,588,764; and 4,007,038 disclose alloys containing rare earth additions. The alloys disclosed therein are, however, dissimilar from that of the subject invention.

It is accordingly an object of the present invention to provide an improved magnetic alloy and improvements in the manufacture thereof.

By incorporating more than 0.01% of at least one rare earth element from the group consisting of yttrium, lanthanum and the elements comprising the lanthanide series within the melt of an alloy having, by weight, from 3 to 19% cobalt, at least 10% chromium, from 10 to 40% of at least one element from the group consisting of chromium, vanadium, titanium, columbium, aluminum, silicon, molybdenum, tungsten and zirconium, up to 0.1% carbon, up to 0.1% nitrogen, up to 1.0% of at least one element from the group consisting of magnesium and calcium, balance iron; and by refining the metal of said melt so as to remove the products resulting from reaction between the rare earth addition and undesirable impurities in the metal: a means for improving the hot ductility of the alloy is provided. The rare earth addition combines with residuals, forming reaction products which are subsequently removed during refining. Rare earth metals are most effective in forming stable high melting point compounds with nitrogen, oxygen and sulfur. Manganese in amounts of at least 0.05% can, however, be added to react with any residual sulfur. Sulfur will form a low melting point cobalt-iron-sulfur eutectic phase during hot working, and as a result thereof can be responsible for hot shortness and a deterioration of hot ductility. The addition of rare earth materials is limited to an amount which will not cause a rare-earth rich phase to appear at the grain boundaries of the alloy. Such phases promote intercrystalline cracking and adversely affect hot ductility. Rare earth additions to the melt are usually in excess of 0.03%. The heat treated magnetic alloy will have no more than 0.5%, and preferably no more than 0.2% of such an addition. Manganese additions to the melt are usually in excess of 0.1%. The heat treated magnetic alloy will have no more than 1.0%, and preferably no more than 0.5%, manganese. The rare earth addition can be in the form of mischmetal. The lanthanide series is composed of those elements having an atomic number of from 58 to 71. Refining is usually accomplished with a basic slag cover during melting, or through use of a consumable electrode remelting process such as vacuum arc or electroslag refining.

In addition to refining, processing includes the steps of: preparing a melt, casting, hot working and heat treating the alloy so as to develop its magnetic properties. Particulars as to said steps are not critical, and can be in accordance with the procedures known to those skilled in the art. The heat treatment can be one aimed at developing either anisotropic or isotropic permanent magnet properties. For anisotropic properties, it can comprise the steps of: solutioning to form a fully ferritic phase devoid of sigma phase, thermally treating in a strong magnetic field to effect a decomposition of the ferritic phase to a structure comprised of a highly magnetic phase dispersed and aligned in a nearly non-magnetic phase, and tempering at a temperature below that at which decomposition took place. Solutioning temperatures will generally be in excess of 1650° F. Those for the thermal magnetic treatment will generally be from 1000° to 1300° F. Tempering temperatures will generally be between 700° F. and that at which decomposition took place. The highly magnetic phase formed during decomposition is comprised mainly of iron and cobalt. The nearly non-magnetic phase is comprised primarily of iron and chromium. For isotropic properties, the field may be eliminated from the thermal magnetic treatment. Alternatively, the thermal magnetic treatment can be eliminated, if the tempering temperature is increased.

Processing can also involve the step of cold rolling. Material which is to be cold rolled must be cooled at a rate of at least 545° F. per minute from a temperature of 1700° F. to a temperature of 800° F., subsequent to hot working and/or the solutioning operation which preceeds cold rolling. The cold ductility of the alloy is impaired if it is not cooled at a reate of at least 545° F. per minute. Although it is not an absolute certainty, it is speculated that the rapid cool avoids both an undesirable ordering reaction and an undesirable high temperature embrittling reaction.

In addition to the limitations imposed hereinabove, melts within the subject invention generally have no more than 5% of elements from the group consisting of silicon, titanium, columbium, aluminum and zirconium, and no more than 20% of elements from the group consisting of vanadium, molybdenum and tungsten. Preferred melt levels from both an individual and synergistic standpoint are as follows: 10 to 17% cobalt; at least 15% chromium, at least 20% of at least one element from the group consisting of chromium, vanadium, titanium, columbium, aluminum, silicon, molybdenum, tungsten and zirconium; and from 1 to 20% vanadium and from 0.1 to 5% titanium.

The magnetic alloy of the present invention consists essentially of, by weight, from 3 to 19% cobalt, at least 10% chromium, from 10 to 40% of at least one element from the group consisting of chromium, vanadium, titanium, columbium, aluminum, silicon, molybdenum, tungsten and zirconium, from 0.01 to 0.5% of at least one rare earth element from the group consisting of yttrium, lanthanum and the elements from the lanthanide series, up to 1.0% manganese, up to 0.1% carbon, up to 0.1% nitrogen, up to 1.0% of at least one element from the group consisting of magnesium and calcium, balance essentially iron. In addition, the alloy contains no more than 5% of elements from the group consisting of silicon, titanium, columbium, aluminum and zirconium, and no more than 20% of elements from the group consisting of vanadium, molybdenum, and tungsten. Preferred levels from both an individual and synergistic standpoint are as follows: 10 to 17% cobalt; at least 15% chromium; at least 20% of at least one element from the group consisting of chromium, vanadium, titanium, columbium, aluminum, silicon, molybdenum, tungsten and zirconium; and from 0.03 to 0.2% of at least one rare earth element from the group consisting of yttrium, lanthanum and the elements from the lanthanide series. Manganese is optionally present in amounts of at least 0.05%, and preferably in amounts of from 0.1 to 0.5%. Structurally the alloy is characterized by a highly magnetic phase dispersed in a nearly nonmagnetic phase. The highly magnetic phase is comprised primarily of iron and cobalt. The nearly nonmagnetic phase is comprised primarily of iron and chromium.

A particular embodiment of the subject invention contains from 1 to 20% vanadium and from 0.1 to 5% titanium, and preferably from 2 to 7% vanadium and from 0.2 to 2% titanium. As titanium and vanadium are ferritizers they extend the desired ferrite phases' existence over an expanded temperature range, and lower the minimum temperature for complete solutioning. They retard the formation of austenite. In addition, they retard the formation of the undesirable hard, non-magnetic sigma phase. By lowering the minimum temperature for complete solutioning, vanadium and titanium broaden the hot working temperature range. They also make it easier to heat treat the alloy, and render it possible to form less scale during heat treating.

The following examples are illustrative of several embodiments of the invention.

Four alloys (Alloys A, B, C and D) were vacuum induction melted. The chemistry of the alloys appears hereinbelow in Table I.

TABLE I

| | COMPOSITION (wt. %) | | | | | | | | | | | |
|---|---|---|---|---|---|---|---|---|---|---|---|---|
| Alloy | Co | Cr | V | Ti | Cb | Al | Si | Rare Earth Metal | Mn | C | N | Fe |
| A | 15.10 | 21.50 | 4.44 | 0.37 | — | — | 0.056 | 0.10* | 0.22 | 0.011 | 0.0061 | Bal. |
| B | 15.10 | 24.92 | — | — | 0.92 | 0.97 | — | 0.10* | 0.27 | 0.011 | 0.0060 | Bal. |
| C | 15.06 | 24.90 | — | — | 0.85 | 0.72 | — | — | <0.05 | 0.0065 | 0.0064 | Bal. |
| D | 17.77 | 27.58 | — | — | — | — | 0.96 | — | <0.05 | 0.0060 | 0.0035 | Bal. |

*melt addition

Alloys A and B had rare earth additions. The rare earth additions were made in the form of a cerium rich mischmetal.

Alloys A and B were subsequently vacuum arc remelted. Alloys C and D were not further refined.

All four alloys were hot forged between 2010° and 1830° F., hot rolled to a 0.125 inch thick strip between 1980° and 1710° F., and water quenched directly from the finishing pass of the hot mill. The cooling rate from 1700° to 800° F. was in excess of 545° F. per minute. The hot workability of the alloys was evaluated. The results appear hereinbelow in Table II.

TABLE II

| Alloy | Hot Workability | Remarks |
|---|---|---|
| A | Excellent | No edge cracking or surface rupturing |
| B | Good | |
| C | Poor | Extensive edge cracking and surface rupturing |
| D | Fair | Had to be hot worked above 1900° F |

From Table II, it is evident that the hot workability of Alloys A and B is superior to that of Alloys C and D. Alloys A and B contain a rare earth addition, whereas Alloys C and D do not. Alloys A and B were also vacuum arc remelted.

The hot rolled strips were subsequently surface conditioned and cold rolled to a thickness of 0.055 inch. Alloys A and B respectively exhibited excellent and good cold workability. The alloys were cooled at a rate in excess of 545° F. per minute from a temperature of 1700° F. to a temperature of 800° F., after hot rolling.

Hot and cold rolled samples of the alloys were heat treated so as to develop their magnetic properties. Alloys A, B and C were solutioned at 1850° F. for one hour, heated in a magnetic field of 3000 oersteds for one hour at a temperature of 1220° F. and tempered at a temperature in excess of 700° F. Alloy D was treated as were Alloys A, B and C with the following exceptions: a solutioning temperature of 2150° F.; and a thermal magnetic temperature of 1185° F. The magnetic properties for Alloys A, B, C and D appear hereinbelow in Table III.

TABLE III

| Alloy | Sample | Br (gauss) | Hc (oersteds) | BH max. (Gauss-oersteds) |
|---|---|---|---|---|
| A | Hot Rolled | 13,720 | 560 | $6.02 \times 10^6$ |
| B | Hot Rolled | 13,180 | 566 | $5.58 \times 10^6$ |
| C | Hot Rolled | 12,950 | 532 | $5.08 \times 10^6$ |
| D | Hot Rolled | 11,800 | 640 | $4.76 \times 10^6$ |
| A | Cold Rolled | 13,800 | 578 | $6.20 \times 10^6$ |

TABLE III-continued

| Alloy | Sample | Br (gauss) | Hc (oersteds) | BH max. (Gauss-oersteds) |
|---|---|---|---|---|
| B | Cold Rolled | 13,000 | 552 | $5.36 \times 10^6$ |
| C | Cold Rolled | 13,200 | 562 | $5.64 \times 10^6$ |
| D | Cold Rolled | 11,950 | 628 | $4.80 \times 10^6$ |

From Table III, it is evident that alloys within the subject invention have excellent magnetic properties. Alloys within the subject invention preferably have a residual magnetic flux density (Br) of at least 11,000 gauss, a coercive force (Hc) of at least 500 oersteds and a maximum energy product (BH max.) of at least $4.5 \times 10^6$ gauss-oersteds. Such requirements are met by Alloys A and B.

Alloys A,C and D were tested to see just how low a solution treatment temperature could be employed. As a result of the tests it was determined that Alloy A could be solutioned at a lower temperature, than could Alloys C and D. Alloy A could be solutioned at a temperature as low as 1700° F. Alloys C and D could not be solutioned at respective temperatures of below 1850° and 2100° F. Alloy A contained vanadium and titanium, whereas Alloys C and D did not.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing an iron-base magnetic alloy having, by weight, from 3 to 19% cobalt, at least 10% chromium, from 10 to 40% of at least one element from the group consisting of chromium, vanadium, titanium, columbium, aluminum, silicon, molybdenum, tungsten and zirconium, up to 0.1% carbon, up to 0.1% nitrogen and up to 1.0% of elements from the group consisting of magnesium and calcium; which process includes the steps of: preparing a melt of said alloy, casting said alloy, hot working said alloy, and heat treating said alloy so as to develop its magnetic properties; the improvement comprising the steps of: incorporating in said melt more than 0.01% of at least one rare earth element from the group consisting of yttrium, lanthanum and the elements from the lanthanide series, and refining said metal so as to remove undesirable products resulting from reaction between said rare earth addition and undesirable impurities, said rare earth addition and refining improving the hot ductility of said metal; said heat treated magnetic alloy having no more than 0.5% of said rare earth addition and no more than 1.0% manganese.

2. The process of claim 1, wherein more than 0.03% of said rare earth addition is incorporated into said melt, and wherein said heat treated magnetic alloy has no more than 0.2% of said rare earth addition.

3. The process of claim 1, including the additional improvement of incorporating more than 0.05% manganese in said melt.

4. The process of claim 3, wherein more than 0.1% manganese is incorporated into said melt, and wherein said heat treated magnetic alloy has no more than 0.5% manganese.

5. The process of claim 1, wherein a basic slag cover is employed during melting to remove said undesirable reaction products.

6. The process of claim 1, wherein said metal is electroslag remelted to remove said undesirable reaction products.

7. The process of claim 1, wherein said metal is vacuum arc remelted to remove said undesirable reaction products.

8. The process of claim 1, including the additional steps of cold working said alloy, and the additional improvement of cooling said alloy from a temperature of 1700° F. to a temperature of 800° F. at a rate of at least 545° F. per minute, subsequent to hot working and prior to cold working.

9. The process of claim 1, adapted to produce anisotropic permanent magnet properties, wherein said heat treatment comprises the steps of: solutioning said alloy to form a fully ferritic phase devoid of sigma phase, thermally treating said alloy in a strong magnetic field to effect a decomposition of the ferritic phase to a structure comprised of a highly magnetic phase dispersed and aligned in a nearly non-magnetic phase, and tempering at a temperature below that at which decomposition took place.

10. The process of claim 9, wherein said solutioning is accomplished at a temperature in excess of 1650° F., said thermal magnetic treatment is at a temperature of from 1000° to 1300° F. and said tempering is at a temperature of at least 700° F.

11. The process of claim 1, adapted to produce an iron-base magnetic alloy having no more than 5% of elements from the group consisting of silicon, titanium, columbium, aluminum and zirconium and no more than 20% of elements from the group consisting of vanadium, molybdenum and tungsten.

12. The process of claim 11, adapted to produce an iron-base magnetic alloy having from 10 to 17% cobalt, at least 15% chromium and at least 20% of at least one element from the group consisting of chromium, vanadium, titanium, columbium, aluminum, silicon, molybdenum, tungsten and zirconium.

13. The process of claim 11, adapted to produce an iron-base magnetic alloy having from 1 to 20% vanadium and from 0.1 to 5% titanium.

14. In a process for producing an iron-base magnetic alloy consisting essentially of, by weight, from 3 to 19% cobalt, at least 10% chromium, from 1 to 20% vanadium, from 0.1 to 5% titanium, up to 0.1% carbon, up to 0.1% nitrogen, up to 1.0% manganese, up to 1.0% of elements from the group consisting of mangnesium and calcium, balance essentially iron with the sum of chromium, vanadium and titanium not exceeding 40%; which process includes the steps of: preparing a melt of said alloy, casting said alloy, hot working said alloy, and heat treating said alloy so as to develop its magnetic properties; the improvement comprising the steps of: incorporating in said melt more than 0.01% of at least one rare earth element from the group consisting of yttrium, lanthanum and the elements from the lanthanide series, and refining said metal so as to remove undesirable products resulting from reaction between said rare earth addition and undesirable impurities, said rare earth addition and refining improving the hot ductility of said metal; said heat treated magnetic alloy having no more than 0.5% of said rare earth addition.

15. The process of claim 14, wherein said iron-base magnetic alloy has from 2 to 7% vanadium and from 0.2 to 2% titanium.

16. A magnetic alloy consisting essentially of, by weight, from 3 to 19% cobalt, from 10 to 40% of at least one element from the group consisting of chromium, vanadium, titanium, columbium, aluminum, silicon, molybdenum, tungsten and zirconium, from 0.01 to 0.5% of at least one rare earth element from the group consisting of yttrium, lanthanum and the elements from the lanthanide series, up to 1.0% manganese, up to 0.1% carbon, up to 0.1% nitrogen, up to 1.0% of elements from the group consisting of magnesium and calcium, balance essentially iron; said alloy having at least 10% chromium, no more than 5% of elements from the group consisting of silicon, titanium, columbium, aluminum and zirconium, and no more than 20% of elements from the group consisting of vanadium, molybdenum and tungsten.

17. A magnetic alloy according to claim 16, having from 10 to 17% cobalt.

18. A magnetic alloy according to claim 16, having at least 15% chromium.

19. A magnetic alloy according to claim 18, having at least 20% of at least one element from the group consisting of chromium, vanadium, titanium, columbium, aluminum, silicon, molybdenum, tungsten and zirconium.

20. A magnetic alloy according to claim 16, having from 0.03 to 0.2% of at least one rare earth element from the group consisting of yttrium, lanthanum and the elements from the lanthanide series.

21. A magnetic alloy according to claim 16, having at least 0.05% manganese.

22. A magnetic alloy according to claim 16, having from 0.1 to 0.5% manganese.

23. A magnetic alloy according to claim 16, having from 1 to 20% vanadium and from 0.1 to 5% titanium.

24. A magnetic alloy according to claim 23, having from 2 to 7% vanadium and from 0.2 to 2% titanium.

* * * * *